US006325048B1

(12) United States Patent
Robinson

(10) Patent No.: US 6,325,048 B1
(45) Date of Patent: Dec. 4, 2001

(54) INTEGRATED MOUNTING OF A PRESSURE REGULATOR IN AN AUTOMOTIVE FUEL SYSTEM

(75) Inventor: Barry S. Robinson, Williamsburg, VA (US)

(73) Assignee: Siemens Automotive Corporation, Auburn Hills, MI (US)

( * ) Notice: Subject to any disclaimer, the term of this patent is extended or adjusted under 35 U.S.C. 154(b) by 0 days.

(21) Appl. No.: 09/348,947

(22) Filed: Jul. 7, 1999

(51) Int. Cl.[7] ..... F02M 41/00
(52) U.S. Cl. ..... 123/463; 123/456
(58) Field of Search ..... 123/463, 456, 123/447, 467, 468, 469

(56) References Cited

U.S. PATENT DOCUMENTS

| | | | | |
|---|---|---|---|---|
| 4,286,563 | | 9/1981 | Fahim et al. | 123/469 |
| 4,570,600 | | 2/1986 | Atkins et al. | 123/468 |
| 4,991,556 | | 2/1991 | Mahnke et al. | 123/463 |
| 5,044,339 | | 9/1991 | Hafner | 123/456 |
| 5,076,320 | * | 12/1991 | Robinson | 137/454.2 |
| 5,105,787 | | 4/1992 | Imoehl | 123/469 |
| 5,163,468 | | 11/1992 | Robinson et al. | 137/315 |
| 5,168,857 | | 12/1992 | Hickey | 123/468 |
| 5,275,203 | | 1/1994 | Robinson | 137/510 |
| 5,355,859 | * | 10/1994 | Weber | 123/497 |
| 5,357,931 | * | 10/1994 | Semence | 123/456 |
| 5,408,971 | | 4/1995 | Jaeger et al. | 123/456 |
| 5,413,077 | * | 5/1995 | Hornby et al. | 123/457 |
| 5,577,478 | * | 11/1996 | Tuckey | 123/456 |
| 5,609,138 | * | 3/1997 | Mutschler | 123/463 |
| 5,797,374 | * | 8/1998 | Minagawa et al. | 123/497 |
| 5,979,409 | * | 11/1999 | Robinson | 123/463 |

* cited by examiner

*Primary Examiner*—Carl S. Miller

(57) ABSTRACT

A fuel pressure regulator in either a returnless or fuel return fuel system for an automotive vehicle is integrally mounted between a fuel rail and an intake manifold port of the engine. A mounting cup is provided on the fuel rail and fuel entry or exit openings for the regulator are sealed by O-ring seals disposed between the regulator and the mounting cup on opposite sides of the fuel openings. The side of the regulator remote from the fuel chamber has a vacuum reference port received in a passage of an intake manifold boss and is sealed to the passage therein by an O-ring. By inserting the pressure regulator into the mounting cup with the O-ring seals and the vacuum reference port of the regulator into the passage of the intake manifold boss, the regulator is clamped between the fuel rail and engine manifold without ancillary connecting elements.

14 Claims, 7 Drawing Sheets

INTEGRATED MOUNTING OF A PRESSURE REGULATOR IN AN AUTOMOTIVE FUEL SYSTEM

TECHNICAL FIELD

The present invention relates to an integrated mounting of a pressure regulator in the fuel system of an internal combustion engine and particularly relates to a mounting of the pressure regulator integrally between a fuel rail and an engine manifold.

BACKGROUND

Conventional pressure regulators for automotive fuel systems are typically not positioned directly adjacent the engine manifold. Rather, such pressure regulators are disposed at remote locations and coupled to the engine manifold by a specifically designed conduit, conventionally a flexible hose. Also, the pressure regulator is typically mounted with specific mounting hardware which, together with the necessary conduit, increase the cost of the fuel system. Further, the additional elements required for remote mounting of the pressure regulator and routing the conduit to the engine manifold occupy usable space in the engine compartment.

In many conventional fuel systems, the regulator is mounted internally within the fuel tank. Internal fuel tank mounting positions for pressure regulators have their own difficulties in mounting, servicing and replacement. In certain return-type fuel systems, a pressure regulator is typically secured to or forms a part of a fuel rail whereby the fuel pressure in the fuel rail is regulated and excess fuel is returned to the fuel supply. In such system, the pressure regulator is normally closed and acts essentially as a pressure relief valve which opens at a predetermined pressure to enable excess fuel in the relief rail to return to the fuel supply. In another conventional returnless fuel system, the pressure regulator is similarly attached to or forms part of the fuel rail. However, the pressure regulator acts as a demand-type valve supplying fuel at a regulated pressure to the fuel rail in response to fuel demand. That is, the pressure regulator valve is normally open and regulates the flow of fuel to the fuel rail. In the event of an over-pressure condition, the pressure regulator closes the valve and an over-pressure relief valve typically in the fuel tank opens to relieve system fuel pressure. In both the return and returnless-type fuel systems, it is desirable to provide a vacuum reference on the pressure regulator to the engine intake manifold. However, as noted previously, the vacuum reference is typically coupled between the engine intake manifold and pressure regulator by a flexible hose or conduit. Accordingly, there has developed a need for mounting the pressure regulator for an automotive fuel system in a manner which is less costly and which increases available engine space by eliminating regulator mounting and connecting parts.

DISCLOSURE OF THE INVENTION

In accordance with the present invention, the pressure regulator, in either return or returnless-type fuel systems, is directly coupled between the fuel rail and the engine intake manifold. In this manner, the need for a flexible hose or conduit interconnecting the vacuum reference port of the pressure regulator and the engine intake manifold is entirely eliminated. Ancillary structure necessary to mount the pressure regulator to the engine and connect it to the fuel rail is entirely eliminated. To accomplish this, the pressure regulator of the present invention is connected directly between the fuel rail and engine manifold. The engine intake manifold is provided with a boss defining a vacuum port to which the vacuum reference port of the pressure regulator is directly connected. The regulator port has an O-ring for sealing with the intake manifold port whereby the regular vacuum reference port can be inserted directly into the manifold port. Further, a mounting cup for the pressure regulator is directly secured to the fuel rail. A pair of O-ring seals are provided between the mounting cup and the pressure regulator enabling fuel to communicate between the fuel rail and the regulator. Thus, the regulator can be simply inserted into the mounting cup on the fuel rail to afford fuel flow between the fuel rail and regulator. With this type of mounting between the regulator and each of the fuel rail and intake manifold, it will be appreciated that the regulator is clamped between those parts without any additional support structure.

In a preferred embodiment according to the present invention, there is provided a fuel system for an internal combustion engine comprising a fuel rail for supplying fuel to fuel injectors, a manifold having a vacuum reference passage, a pressure regulator for regulating the pressure of the fuel in the fuel rail supplied to the fuel injectors, the pressure regulator having an opening for communicating fuel between the fuel rail and the regulator and a vacuum reference port, the regulator being fixedly mounted between the fuel rail and the manifold with the fuel opening in communication with the fuel rail and the vacuum reference port secured directly to the manifold and lying in direct communication with the manifold vacuum reference passage.

In a further preferred embodiment according to the present invention, there is provided a fuel system for an internal combustion engine comprising a fuel rail for supplying fuel to fuel injectors, a mounting cup provided on the fuel rail, a manifold having a vacuum reference passage, a pressure regulator for regulating the pressure of the fuel in the fuel rail supplied to the fuel injectors and at least in part receivable within the mounting cup, the regulator having an opening for communicating fuel between the fuel rail and the regulator, seals between the mounting cup and the regulator for sealing the regulator and mounting cup on opposite sides of the opening, the pressure regulator having a vacuum reference port, the regulator being fixedly mounted between the fuel rail and the manifold with the fuel opening in communication with the fuel rail and the vacuum reference port in direct communication with the manifold vacuum reference passage.

BEST MODE FOR CARRYING OUT THE INVENTION

Figure 1:
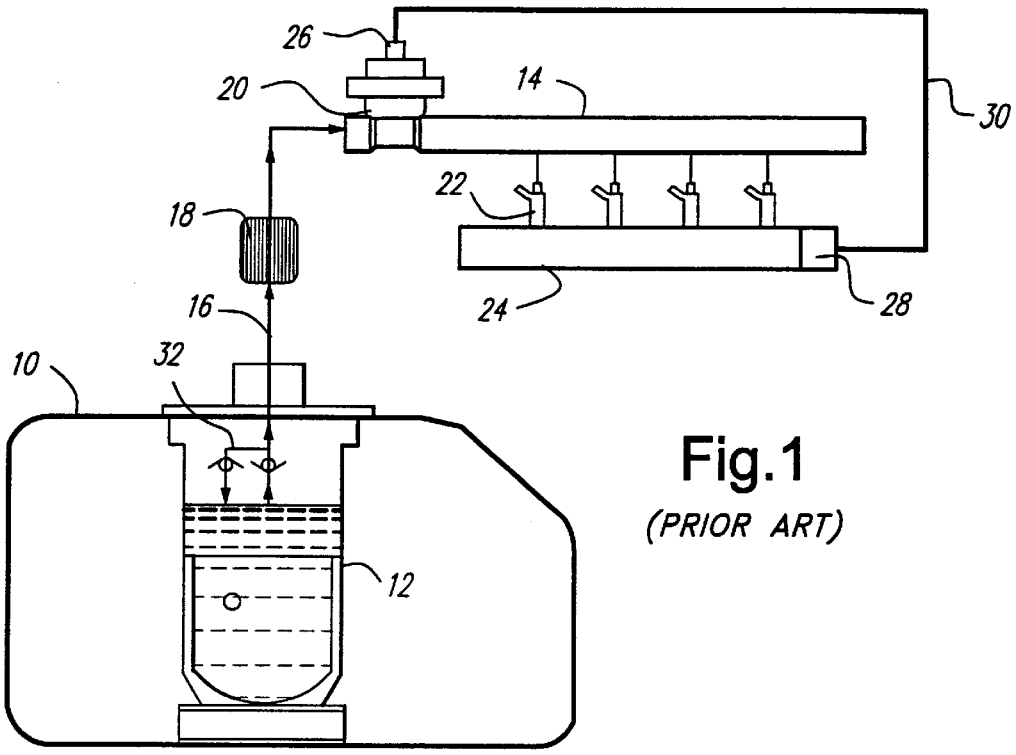
Fig.1 (PRIOR ART)
FIG. 1 is a schematic illustration of a prior art fuel system incorporating a returnless pressure regulator mounted on the fuel rail.

Referring now to the drawings, particularly to FIG. 1, there is illustrated a conventional fuel system of the type, for example, illustrated in U.S. Pat. No. 5,413,077, the disclosure of which is incorporated by reference. In that fuel system, fuel is supplied from a fuel tank 10 by a pump 12 within tank 10 to a fuel rail 14 via a fuel line 16 which passes fuel through a fuel filter 18 and a pressure regulator 20 to rail 14. Fuel rail 14, of course, supplies fuel under regulated pressure to the injectors 22 of a fuel-injected engine 24. The pressure regulator 20, as set forth in the above-noted patent, includes a spring-biased ball-type valve movable relative to a valve seat by the cooperation of the spring and a diaphragm mounting an actuator for the ball of the valve. One side of the diaphragm includes a vacuum reference port 26, typically coupled to a manifold 28 on engine 24 via line 30, conventionally a flexible hose or coupling. The pressure regulator 20 thus serves as a demand-type valve, reducing the pressure of the fuel supplied from the pump 12 to a regulated pressure for supply to injectors 22. Line 16 includes a bypass line 32 for returning fuel to the tank 10.

Figure 2:
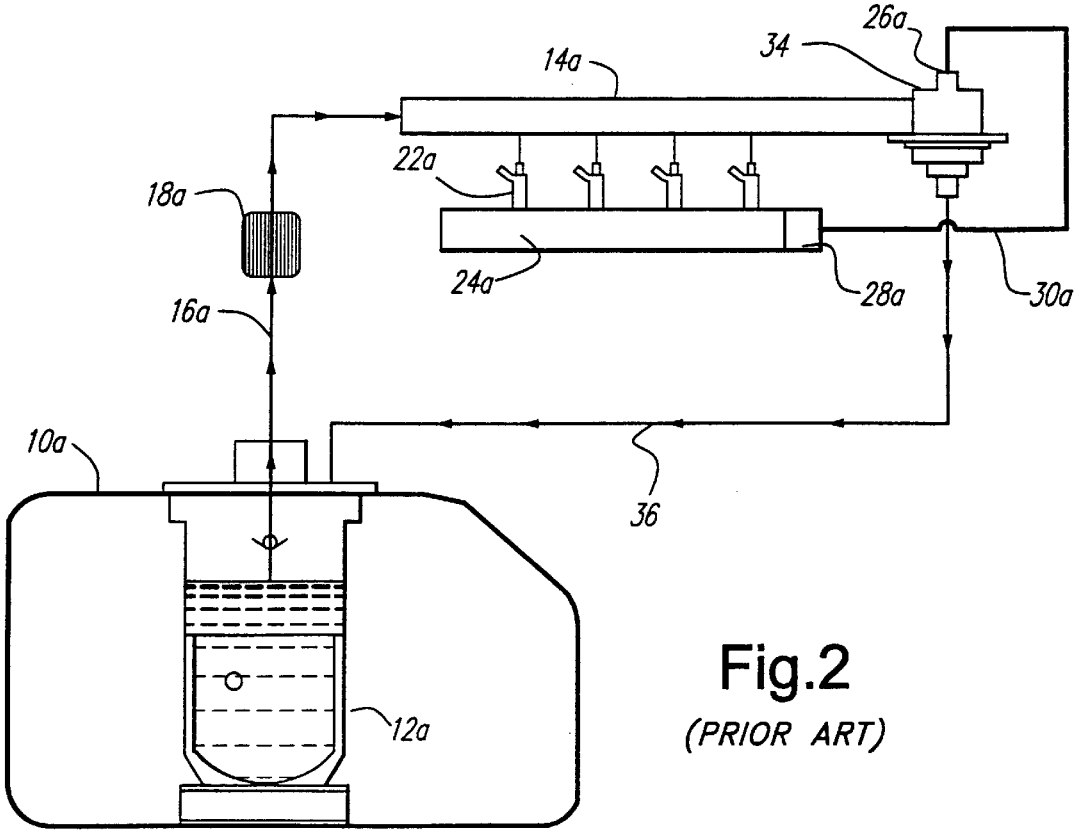
Fig.2 (PRIOR ART)
FIG. 2 is a schematic illustration of a prior art fuel system incorporating a fuel pressure regulator of a type for returning excess fuel supplied to the fuel rail back to the fuel tank.

Referring to FIG. 2, there is illustrated another conventional fuel system wherein like reference numerals are applied to like parts, followed by the suffix "a." In this form, however, the fuel pressure regulator 34 may be of the type illustrated in U.S. Pat. No. 4,991,556, the disclosure of which is incorporated by reference. In that patent, there is disclosed a fuel system wherein the pressure regulator 34 regulates the pressure in the fuel rail 14*a* and returns excess fuel supplied to the fuel rail by a return line 36 to the fuel tank 10*a*. In that system, the vacuum reference port 26*a* of the pressure regulator 34 is coupled, typically by a flexible hose 38 to the intake manifold vacuum reference 28*a*. The pressure regulator 34 in this system acts as a pressure relief valve, returning fuel to the fuel tank in response to an excess pressure condition in the fuel rail 14*a*.

Figure 3:
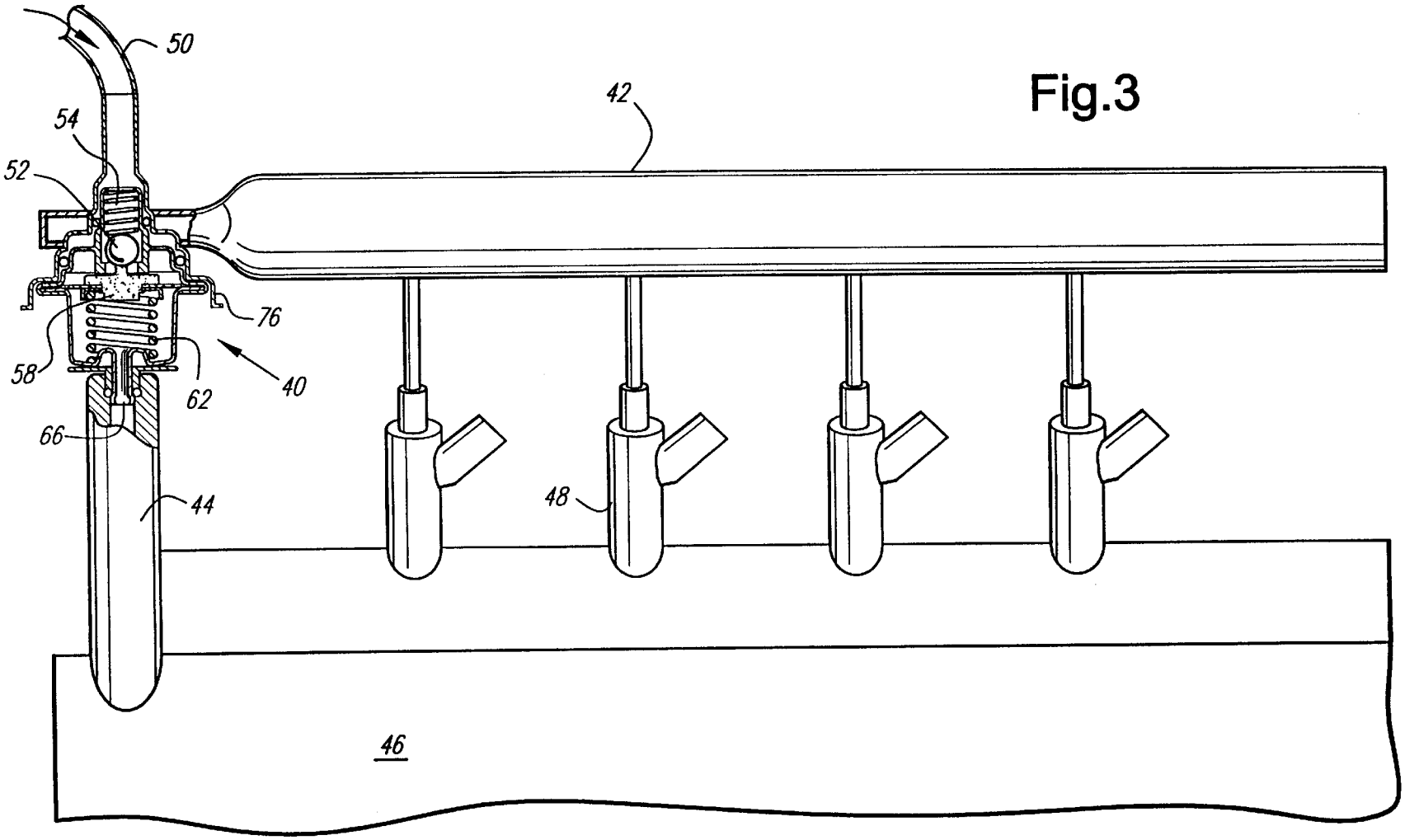
FIG. 3 is an illustration of an integrated mounting of a pressure regulator between a fuel rail and an engine intake manifold according to the present invention in a returnless-type fuel system.
Figure 4:
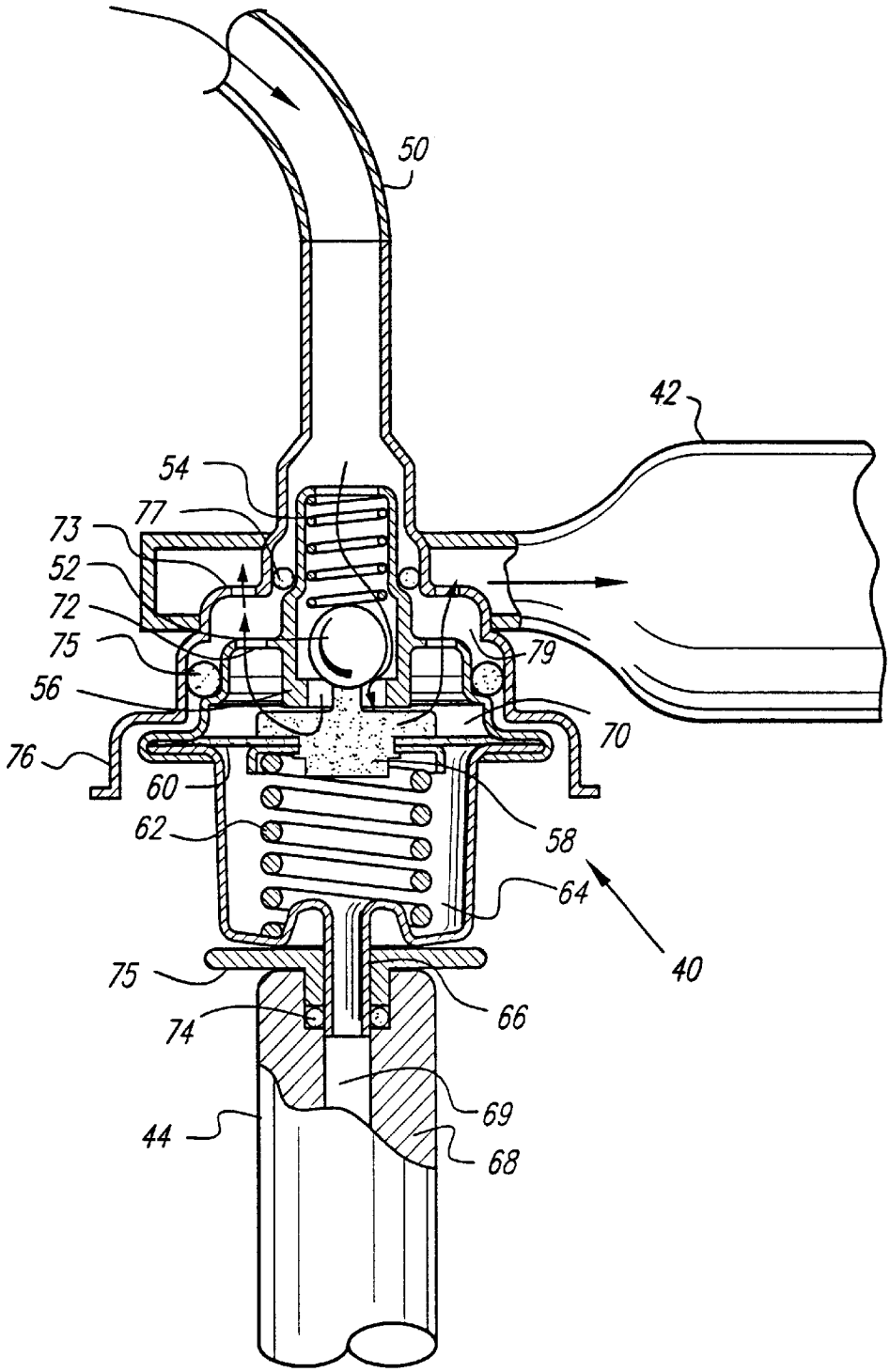
FIG. 4 is an enlarged fragmentary cross-sectional view of the pressure regulator mounting between the fuel rail and engine intake manifold of FIG. 3.
Figure 5:
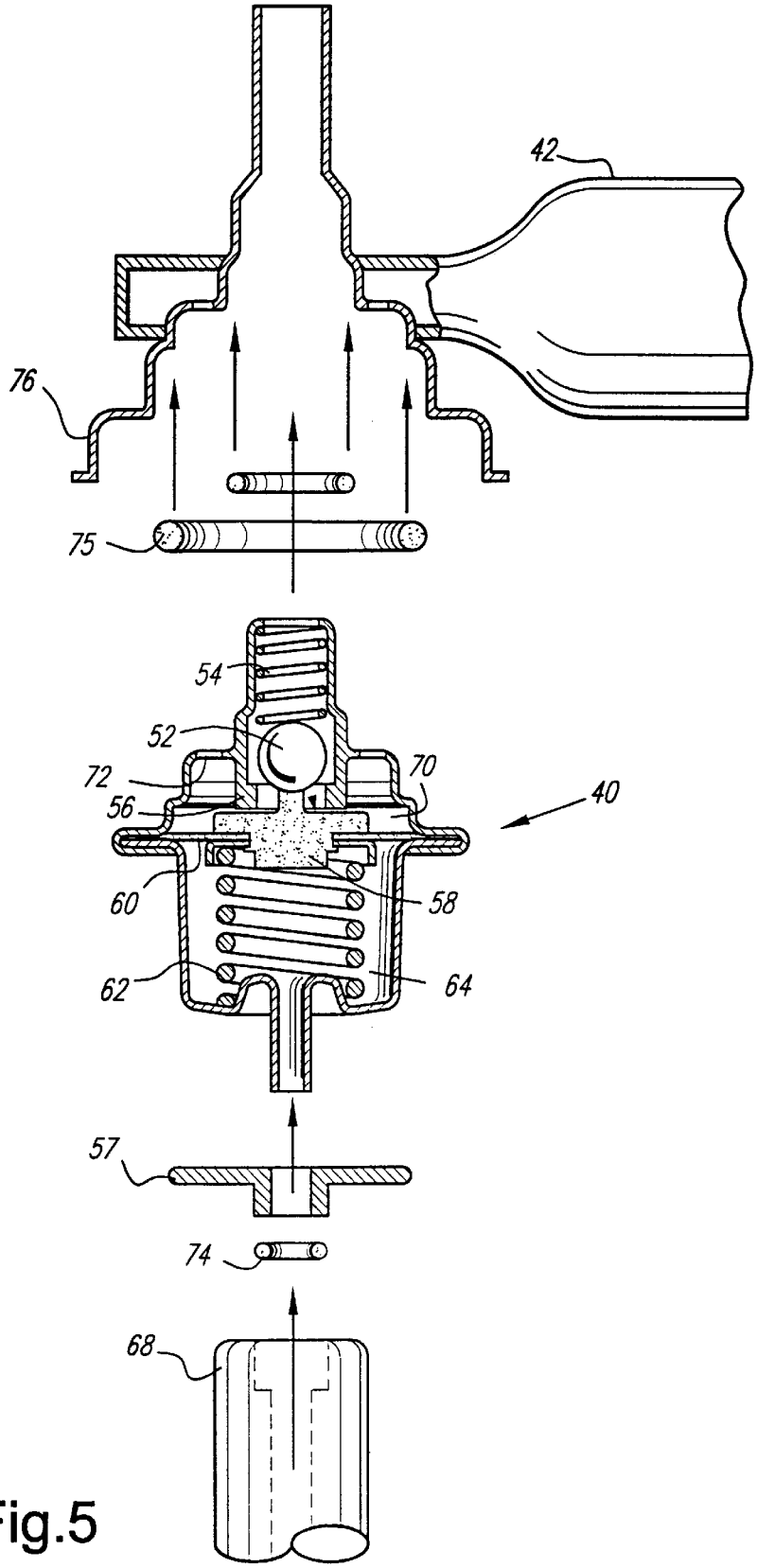
FIG. 5 is an exploded view of the mounting of the pressure regulator between the fuel rail and the engine intake manifold illustrated in FIG. 4.

Referring now to FIGS. 3–5, there is illustrated an integrated mounting of a pressure regulator between an engine intake manifold and a fuel rail in accordance with the present invention and in a returnless-type fuel system. The system illustrated in FIGS. 3 and 4 is the functional analog of the conventional system illustrated in FIG. 1 with an integrated mounting of the pressure regulator, generally designated 40, between the fuel rail 42 and the intake manifold reference 44 of the engine 46 in accordance with the present invention. As in FIG. 1, fuel injectors 48 are supplied with fuel from the fuel rail 42 and which fuel, in turn, is supplied via a fuel line 50 from the fuel tank to the fuel rail through the pressure regulator 40. The pressure regulator 40 is conventional per se. For example, the pressure regulator may be of the type illustrated in U.S. Pat. No. 5,413,077. Briefly, the pressure regulator includes, as best illustrated in FIG. 4, a ball 52 biased by a spring 54 toward a valve seat 56. The spring 54 and ball 52 lie in a chamber in communication with the fuel inlet line 50 for supplying fuel past the valve seat 56 when the ball 52 is displaced therefrom by a central element 58 carried by a diaphragm 60. Diaphragm 60 is biased by a spring 62 which lies in a chamber 64 in communication via vacuum reference port 66 with the intake manifold vacuum via a boss 68 mounted on the engine and having a passage 69. The chamber 70 on the opposite side of diaphragm 60 from chamber 64 lies in open communication with the fuel rail 42 via apertures 72 of regulator 40 and apertures 73 in a mounting cup 76. Thus, the fuel is supplied via line 50 past the ball valve 52 and seat 56 on demand depending upon the difference in pressure between the chambers 70 and 64.

Significant to the present invention is the mounting of the pressure regulator 40 directly between the fuel rail 42 and the intake manifold, e.g., boss 68, containing intake manifold vacuum reference passage 69. It will be seen that the vacuum reference port 66 is directly coupled to the manifold port boss 68 with its distal end being received in passage 69 and sealed by an O-ring 74. A fitting 75 is interposed between the regulator and the boss. Alternatively, the vacuum reference port on the regulator can be in the form of a recess for receiving a projecting nipple forming an intake manifold reference port. As illustrated, the mounting cup 76 is suitably secured to the end 78 of the fuel rail 42, forming a recess for receiving the pressure regulator. A pair of O-ring seals 75 and 77 are provided in the regulator mounting cup 76 to to seal between the regulator 40 and cup 76 and seal the fuel chamber 70 and the annular space 79 between the base of the regulator and the base of the cup. By locating the regulator between the mounting cup and boss during assembly of the engine components, the regulator 40 can be readily installed simply by inserting the regulator into the mounting cup and its vacuum reference port in the passage of the boss. It will be appreciated that the regulator essentially floats, while sealed, between the fuel rail and the intake manifold boss on the engine. It will be appreciated that the typical flexible conduit, for example, conduit 30 illustrated in FIG. 1 between the vacuum reference port of the pressure regulator and the intake manifold has been entirely eliminated in the pressure regulator mounting hereof, thereby minimizing space and assembly requirements.

Figure 6:
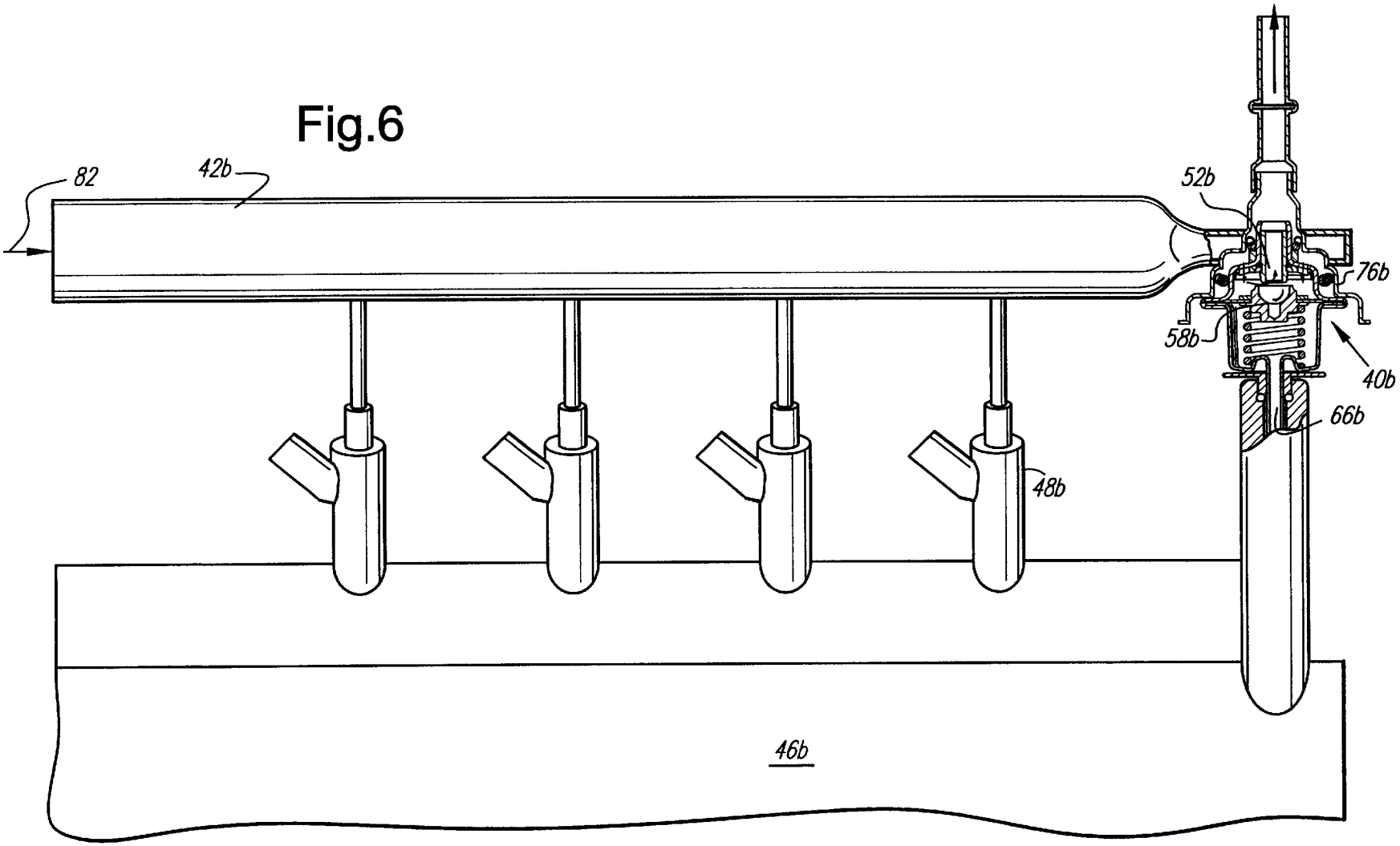
FIG. 6 is a view similar to FIG. 3 illustrating an integrated mounting of a pressure regulator between the fuel rail and engine intake manifold in a fuel system of the type for returning excess fuel to the fuel tank.
Figure 7:
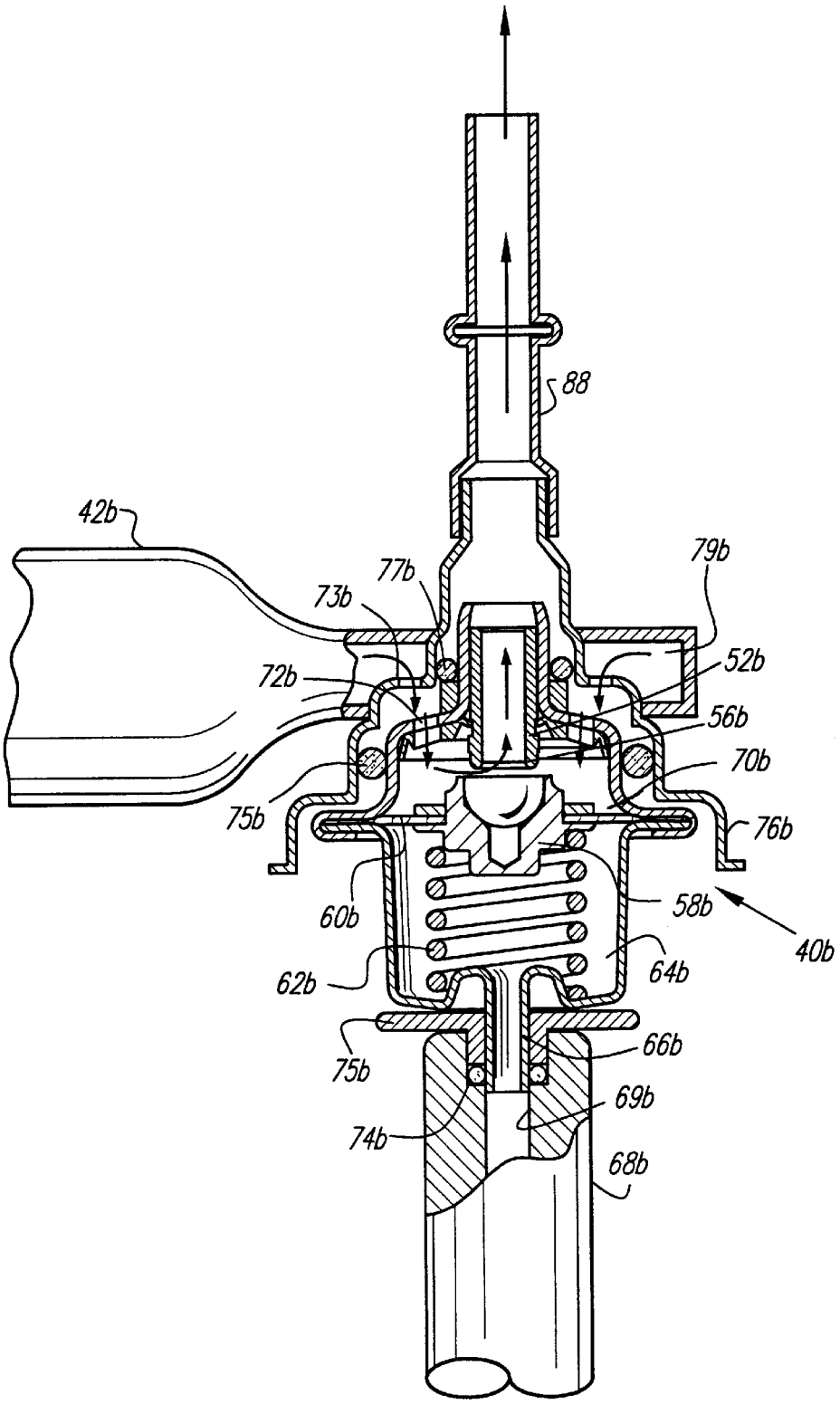
FIG. 7 is an enlarged side elevational view thereof with parts in cross-section.
Figure 8:
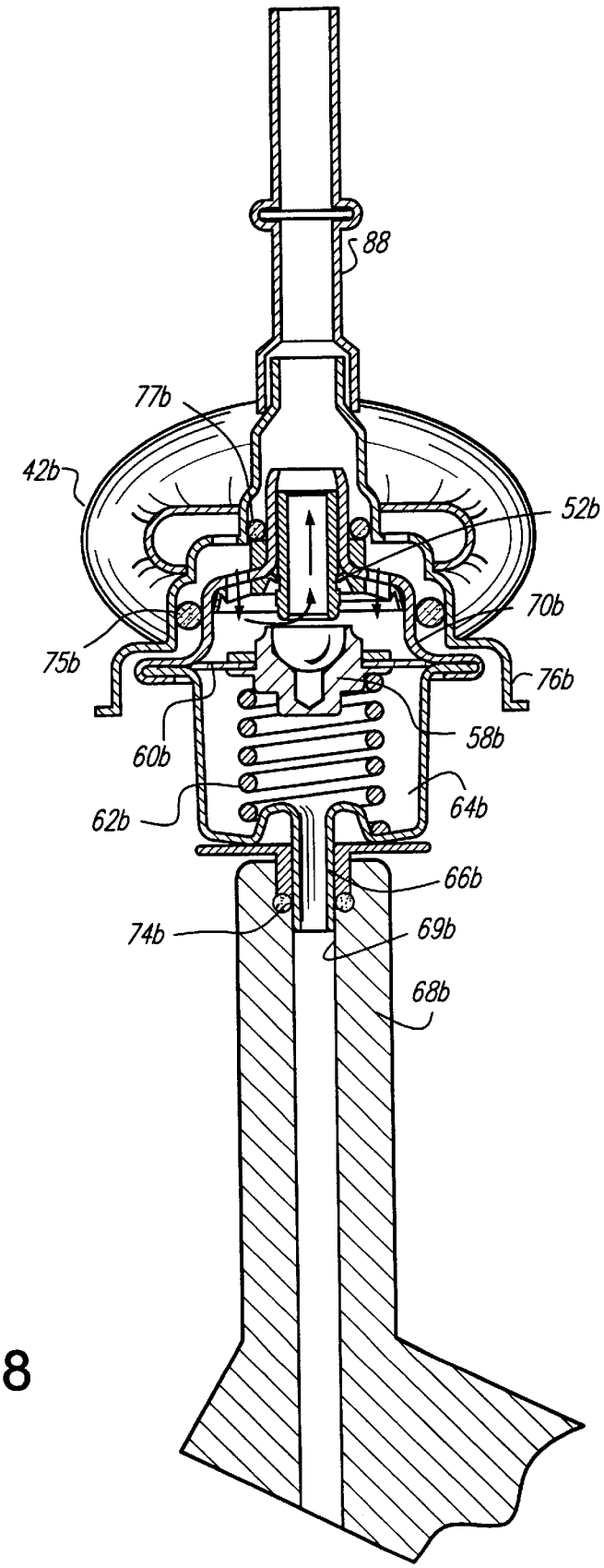
FIG. 8 is a cross-sectional view of the mounting of FIG. 7 end-on to the fuel rail.

Referring now to FIGS. 6 and 7, there is illustrated an integrated mounting of a pressure regulator useful in a return-type fuel system where excess fuel in the fuel rail is returned to the fuel tank, similarly as in the conventional system of FIG. 2. Like parts as in the system of FIGS. 3–5 are denoted by like reference numerals followed by the suffix "b." The pressure regulator 40*b* in this system is disposed at an end of the fuel rail 42*b* opposite to a fuel inlet line 82. Thus, fuel is supplied from the fuel rail 42*b* at a pressure regulated by pressure regulator 40*b* to the injectors 48*b* of the engine 46*b*. However, the fuel flow through the pressure regulator 40*b* is opposite to the flow illustrated in FIG. 4. Thus, referring to FIG. 7, the fuel flow from the fuel rail 42*b* flows through the openings 73*b* and 72*b* into the fuel chamber 70*b* for flow past the valve seat 56*b* and into a return line 88 for flow to the fuel tank. The diaphragm 60*b* regulates the fuel pressure in the fuel rail by opening or closing in response to the difference in pressure between chambers 70*b* and 64*b*.

As in the prior embodiment, the mounting cup 76*b* is secured to the flattened end of the fuel rail 42*b*. Consequently, the pressure regulator 40*b* may be inserted into the recess of the cup 76*b* with the O-ring seals 75*b* and 77*b* sealing between the base of the regulator and the cup to seal the communicating fuel chamber 70*b* and the annular space 79*b* between the base of the regulator and the mounting cup. Additionally, it will be appreciated that the vacuum reference port 66*b* is directly connected to the intake manifold boss 68*b* with the distal end of the port 66*b* being received through the fitting 75*b* and into passage 69*b*. An O-ring seal 74*b* is provided between the boss 68*b* and the vacuum reference port 66*b*. As in the prior embodiment, the pressure regulator 40*b* can be interposed between the mounting cup and the boss during assembly of the engine components, the pressure regulator being effectively clamped between the end of the fuel rail and the boss 68*b*. Optionally, mounting clips can be used to further secure the pressure regulator between the fuel rail and the intake manifold boss. Consequently, the flexible conduit typically disposed between the pressure regulator and the intake manifold port has been entirely eliminated, as well as ancillary mounting structure for remote mounting of the regulator.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A fuel system for an internal combustion engine comprising:

a fuel rail for supplying fuel to fuel injectors;

a manifold having a vacuum reference passage;

a pressure regulator for regulating the pressure of the fuel in the fuel rail supplied to the fuel injectors;

said pressure regulator having an opening for communicating fuel between said fuel rail and the regulator and a vacuum reference port, said regulator being fixedly mounted between said fuel rail and said manifold with said fuel opening in communication with said fuel rail and said vacuum reference port secured directly to said manifold and lying in direct communication with said manifold vacuum reference passage.

2. A system according to claim 1 wherein one of said manifold vacuum reference passage and said vacuum reference port includes a projection and another of said manifold vacuum reference passage and said vacuum reference port includes a recess for receiving said projection and a seal between said one projection and walls defining said recess.

3. A system according to claim 1 wherein said fuel rail is spaced from said manifold and said pressure regulator is clamped between said fuel rail and said manifold.

4. A system according to claim 1 including a fuel supply, said pressure regulator including a fuel return conduit for returning fuel to said fuel supply in response to pressure within said fuel rail in excess of a predetermined pressure.

5. A system according to claim 1 wherein said pressure regulator includes a valve and diaphragm responsive to a difference in manifold pressure and fuel pressure to regulate fuel pressure in said fuel rail in accordance with fuel demand.

6. A fuel system for an internal combustion engine comprising:

a fuel rail for supplying fuel to fuel injectors;

a mounting cup provided on said fuel rail;

a manifold vacuum reference passage;

a pressure regulator for regulating the pressure of the fuel in the fuel rail supplied to the fuel injectors and at least in part receivable within said mounting cup, said regulator having an opening for communicating fuel between said fuel rail and said regulator;

seals between said mounting cup and said regulator for sealing the regulator and mounting cup on opposite sides of said opening;

said pressure regulator having a vacuum reference port;

said regulator being fixedly mounted between said fuel rail and said manifold with said fuel opening in communication with said fuel rail and said vacuum reference port in direct communication with said manifold vacuum reference passage, wherein one of said manifold vacuum reference passage and said vacuum reference port includes a projection and another of said manifold vacuum reference passage and said vacuum reference port includes a recess for receiving said projection and a seal between said one projection and walls defining said recess.

7. A system according to claim 6 wherein said regulator has a diaphragm in part defining on opposite sides thereof a fuel chamber in communication with said fuel opening and a manifold intake pressure reference chamber, respectively, said port lying in communication with said passage.

8. A system according to claim 6 wherein said fuel rail is spaced from said manifold and said pressure regulator is clamped between said fuel raid and said manifold.

9. A system according to claim 6 including a fuel supply, said pressure regulator including a fuel return conduit for returning fuel to said fuel supply in response to pressure within said fuel rail in excess of a predetermined pressure.

10. A system according to claim 6 wherein said pressure regulator includes a valve and diaphragm responsive to a difference in manifold pressure and fuel pressure to regulate fuel pressure in said fuel rail in accordance with fuel demand.

11. A fuel system for an internal combustion engine, the fuel system comprising:

a fuel rail;

an intake manifold of the internal combustion engine; and a pressure regulator in fluid communication with the manifold and with the fuel rail, a first one of said pressure regulator and said manifold having a nipple and a second one of said pressure regulator and said manifold having a recess receiving said nipple.

12. A fuel system according to claim 11 wherein said fuel rail is spaced from said manifold and said pressure regulator is clamped between said fuel rail and said manifold.

13. A fuel system according to claim 11 further comprising:

a fuel supply, and a fuel return conduit returning fuel from said pressure regulator to said fuel supply in response to pressure within said fuel rail exceeding a predetermined pressure.

14. A fuel system according to claim 11 wherein said pressure regulator comprises a valve and diaphragm responsive to a difference in manifold pressure and fuel pressure to regulate fuel pressure in said fuel rail in accordance with fuel demand.

* * * * *